United States Patent [19]

Broadbent

[11] Patent Number: 4,922,723

[45] Date of Patent: May 8, 1990

[54] APPARATUS AND METHOD FOR MAKING ICE CUBES WITHOUT A DEFROST CYCLE

[75] Inventor: John A. Broadbent, Golden Valley, Minn.

[73] Assignee: Broad Research, Golden Valley, Minn.

[21] Appl. No.: 271,228

[22] Filed: Nov. 14, 1988

[51] Int. Cl.[5] ..... F25C 1/12

[52] U.S. Cl. ..... 62/72; 62/75; 62/353

[58] Field of Search ..... 62/72, 75, 353, 351

[56] References Cited

U.S. PATENT DOCUMENTS

| | | | |
|---|---|---|---|
| 2,610,476 | 9/1952 | Field | 62/72 |
| 2,613,511 | 10/1952 | Walsh | 62/72 |
| 2,683,356 | 7/1954 | Green, Jr. | 62/106 |
| 2,683,359 | 7/1954 | Green, Jr. | 62/114 |
| 2,803,950 | 8/1957 | Bayston | 62/72 X |
| 2,990,199 | 6/1961 | Field | 62/72 |
| 3,308,631 | 3/1967 | Kniffin | 62/137 |
| 3,318,106 | 5/1967 | Litman | 62/189 |
| 3,404,543 | 10/1968 | Diblick | 62/344 |
| 3,739,595 | 6/1973 | Learn et al. | 62/135 |

*Primary Examiner*—William E. Tapolcai

*Attorney, Agent, or Firm*—Merchant, Gould, Smith, Edell, Welter & Schmidt

[57] ABSTRACT

An apparatus and method for forming ice cubes without a hot gas defrost cycle comprises a flexible sheet (55) which is urged into and out of thermal contact with a refrigerated plate (51) through openings in an insulative spacer (52) defining the freezing sites where the ice cubes are built up to the desired thickness by lamination.

9 Claims, 6 Drawing Sheets

APPARATUS AND METHOD FOR MAKING ICE CUBES WITHOUT A DEFROST CYCLEcl

TECHNICAL FIELD

This invention relates generally to refrigeration. More particularly, this invention concerns a method and apparatus for efficiently and continuously freezing liquids such as water into uniformly shaped and sized "cubes" or "blocks" of high quality through the lamination of thin ice layers without a defrost cycle.

BACKGROUND OF THE INVENTION

Automatic ice cube machines are widely used in restaurants, bars, hotels, etc. Such commercial machines typically form ice cubes by freezing a flowing stream of water on the chilled evaporator portion of a refrigeration system. After the ice has been formed to the desired thickness, the evaporator is heated, thereby melting the bond between the ice and the evaporator and allowing the ice to then fall or be pushed into an ice holding bin below. Heating of the evaporator is typically accomplished using a defrost cycle or "hot gas defrost," whereby hot refrigerant from the compressor is caused to bypass the condenser and go directly into the evaporator. The hot gas defrost cycle ends after the ice cubes have fallen away from the evaporator.

Such a hot gas defrost cycle adversely affects the capacity and energy efficiency of the ice machine. The ice making capacity is significantly reduced because: (1) the ice machine cannot produce ice while it is in a defrost cycle, (2) it actually melts some ice during this cycle, and (3) the heat added to the evaporator during hot gas defrost must be removed from the evaporator before freezing can start again—which means that the machine's refrigerating capacity is being used to remove heat added during defrost rather than to make ice. Also, because the ice making machine is consuming energy during the defrost process but is not making ice, the energy efficiency is significantly lower than that of an ice machine with no defrost cycle.

The capacity and energy efficiency of an ice making machine are also affected by the refrigeration system's condensing and evaporating temperatures. It is well known that raising the condensing temperature and/or lowering the evaporating temperature in a refrigeration system lead to a reduction of the heat transfer output and efficiency of the system. In order to quickly heat the evaporator for a fast defrost, cube making ice machines often have a higher condensing temperature than would otherwise be required. This also leads to lower capacity and efficiency.

In addition, the evaporating temperatures typically used on cube making ice machines are often less than optimal. This is due primarily to the thickness of the ice produced. Because ice is a relatively poor conductor of heat, it tends to insulate the evaporator surface more as it grows thicker. To maintain the desired rate of heat transfer, the evaporating temperature must therefore drop to overcome this insulating effect. The thicker the ice cubes, the more the evaporating temperature must drop. This drop in evaporating temperature contributes further to a reduction in ice producing capacity and energy efficiency.

Another disadvantage of ice machines using hot gas defrost is their reduced service life. An ice machine which utilizes a defrost cycle constantly cycles between warm and cold. This constant thermal cycling causes the main components to wear out faster than they would otherwise.

Yet another drawback of most existing ice cube making machines is their inability to produce ice cubes of various shapes and sizes. An ice machine with the ability to make ice cubes of various shapes (such as the shape of a company's logo, for example) would have an advantage in the marketplace over traditional ice machines. This ability would also allow ice cubes to be designed with various desirable properties (e.g., slow melting ice cubes, quick melting ice cubes, no-splash ice cubes, etc.).

Various machines and methods for making ice have been available heretofore. For example, U.S. Pat. Nos. 2,683,356 and 2,683,359 to Charles M. Green, Jr. describe an ice making method and apparatus whereby ice is formed on deformable refrigerated plates that are submerged under water. After a layer of ice has formed on the refrigerated plates, the plates are alternately flexed between a concave and a convex shapes. This causes the ice layer on the plate to be partially broken away from the plate forming small pockets between the plates and the ice layer. These pockets then fill with a thin layer of water that freezes and becomes part of the total ice layer. As the flexing of the plates is repeated, many of these thin layers are laminated together building up a fairly thick piece of ice. Eventually, with repeated flexing of the deformable plates, irregularly shaped pieces of ice, or "cubes," break free from the plate. If the process is continued without removal of these ice pieces, a large block of ice is formed as all the small pieces freeze together. While Green's method will produce ice without the use of a defrost cycle, it will not produce clear, uniformly shaped cubes. Rather, the cubes produced will be cloudy and randomly shaped both in thickness and in cross-sectional shape because the water that is frozen has been trapped in pockets between previously frozen layers of ice and the freezing surface. Since no water flow is possible in these pockets, the impurities and dissolved gases in the water cannot be removed——the impurities are simply frozen into the ice layer resulting in cloudiness. The irregular shape of the ice pieces produced results from the lack of any type of control over the ice layer thickness or how the ice breaks free from the refrigerated plates.

Flaker-type ice machines do not utilize a hot gas defrost cycle; but cannot make cubes, much less cubes of various predetermined configurations.

The primary objective of this invention is to provide a machine or apparatus for making hard, clear, uniformly shaped ice in various configurations, both cube and noncube-shaped, which does not require hot gas defrost and which thus provides greater ice producing capacity, greater energy efficiency and longer service life than conventional cube making ice machines. By eliminating the hot gas defrost, the condenser can operate at a lower, more efficient condensing temperature. A high condensing temperature will not be required to facilitate a fast defrost.

Another primary objective of this invention is to provide a machine or apparatus for making clear ice in various configurations by laminating together thin layers of ice. By making the ice in thin layers, the insulative effect of the ice is minimized and the thermal efficiency is improved. Lamination of thin ice layers into larger cubes still allows them to be made to the desired size and shape. Improving thermal efficiency also allows a decrease in the freezing surface area needed for a given ice producing capacity. This surface area reduction in turn helps reduce the machine cost. Because of the higher thermal efficiency, a higher, more efficient, evaporating temperature can be used.

A further object of this invention is to provide a machine or apparatus which can produce clear, uniformly shaped ice cubes of virtually any desired cross-sectional shape and virtually any desired thickness.

A further object of this invention is to provide a method of efficiently and continuously freezing liquids (including, but not limited to water) into their solid form, which does not require a defrost cycle and also minimizes the insulative effect of the frozen layer.

SUMMARY OF THE INVENTION

The invention herein comprises an ice making method and apparatus which provides improved ice making capacity, greater energy efficiency and longer service life through a novel means of forming and harvesting ice of various configurations. In addition it provides the flexibility to produce clear, uniformly shaped ice cubes of any desired cross-sectional shape with any desired thickness.

As used herein, the term "ice cube" shall not be limited to describing a regular solid piece of ice with six sides, but includes pieces of ice of any suitable shape.

This invention deals primarily with the evaporator or ice forming portion, of an ice making machine. The other components required in the ice-making machine (i.e., refrigeration system, water source and flow control, ice holding bin, etc.) are similar to those found in conventional ice-making machines.

The invention is unique in that ice is made in thin layers on a flexible surface. These thin layers are automatically laminated together to form full-sized ice cubes. A flexible freezing surface allows the ice to be harvested without a defrost cycle, thus permitting continuous operation, higher efficiency, increased ice producing capacity and a longer service life. Forming the ice in thin layers provides optimum heat transfer efficiency (since the insulative effect of the ice layer is kept to a minimum), allowing reduced surface area and higher, more efficient evaporating temperatures.

The invention herein makes possible a cuber-type ice machine which can operate as efficiently as a flaker-type ice machine and can be built at a competitive price. To achieve this, two simple principles are applied: first, that ice can be easily removed from a flexible surface without defrosting, and second, that a solid ice cube of any desired thickness can be made by freezing together, or laminating, multiple thin layers of ice.

In the preferred embodiment, ice is formed on a very thin, flexible surface (e.g., an approximately 0.001 inch thick sheet of stainless steel or a sheet of plastic of suitable thickness) which is connected to a refrigerated plate. The flexible surface and the refrigerated plate are arranged so that a sealed chamber is defined therebetween. This chamber is filled with a low toxicity, low freezing temperature heat transfer fluid (such as propylene glycol or DOWFROST to insure good heat transfer between the flexible freezing surface and the refrigerated plate) and a thin layer of insulation. The insulation includes holes which define the areas where the flexible freezing surface and the refrigerated plate can come into direct contact. By applying a slight vacuum or negative pressure to the chamber between the flexible surface and the refrigerated plate, the flexible surface is drawn into intimate contact with the refrigerated plate at the holes in the insulation. Water flowing on the opposite side of the flexible surface freezes on those areas where the flexible surface is in good thermal contact with the refrigerated plate, i.e. the areas defined by the holes in the insulation. The hole configurations thus determine the cross-sectional shape of the resultant ice cubes built up by lamination.

Thin resistance heating wires are provided on a moveable assembly on the water-side of the flexible freezing surface for removing the frozen ice layer from the flexible freezing surface. The wires are normally de-energized and at ambient temperature. Before freezing begins, the wires are brought into contact with the water-side of each freezing site (as defined by the holes in the insulation). As the water freezes, these wires become imbedded in the growing ice layer. When the first ice layer has reached the desired thickness (preferably just thick enough to imbed the wires), the negative pressure on the chamber between the flexible surface and the refrigerated plate is removed, and the assemblies holding the wires are pulled away from the flexible freezing surface. Without such negative pressure, the flexible freezing surface is free to flex so that the ice can be removed without defrosting. The ice formed will thus be free of the flexible freezing surface, but still securely attached to the wires. With the wires and the attached ice layer held away from the freezing surface, the negative pressure will then be re-applied to the chamber between the flexible surface and the refrigerated plate to resume ice formation.

The second layer of ice is formed in a very short time, keeping the ice thickness to a minimum. The wires, with the first ice layer still attached, are then moved towards the freezing surface until the first and second ice layers have been brought into contact, causing the first and second layers to freeze or laminate together in about 15 seconds. The negative pressure is then removed, and the ice is again pulled off the flexible freezing surface by the still-attached wires.

These steps are repeated until enough ice layers have been laminated together to form an ice cube of the desired thickness. After this has been accomplished and the ice cubes have been pulled free from the flexible freezing surface, a voltage is applied to the resistance heating wires causing them to heat and melt the ice bonding the ice cubes to the wires. The ice cubes then drop into an ice holding bin below. The process then starts again. This cycle repeats until the ice holding bin has been filled with ice cubes.

One alternative embodiment utilizes a very similar apparatus, except the means for defining the freezing sites is different. In this alternative embodiment, raised conductive areas on the refrigerated plate determine the areas where the flexible freezing surface and the refrigerated plate may come into contact. This technique is most appropriate when the flexible freezing surface is made from a relatively stiff material, such as stainless steel. The shape of the raised areas determines the cross-sectional shape of the ice cubes formed. Unlike the insulating sheet method for determining the freezing sites, this embodiment does not allow the shape of the ice cubes to be as easily changed.

Another alternative embodiment utilizes a similar apparatus, but facilitates the removal of the ice layers by applying a positive pressure to the chamber between the refrigerated plate and the flexible freezing surface. This positive pressure causes the flexible freezing surface to flex outward helping to break the bond between the freezing surface and the ice formed.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
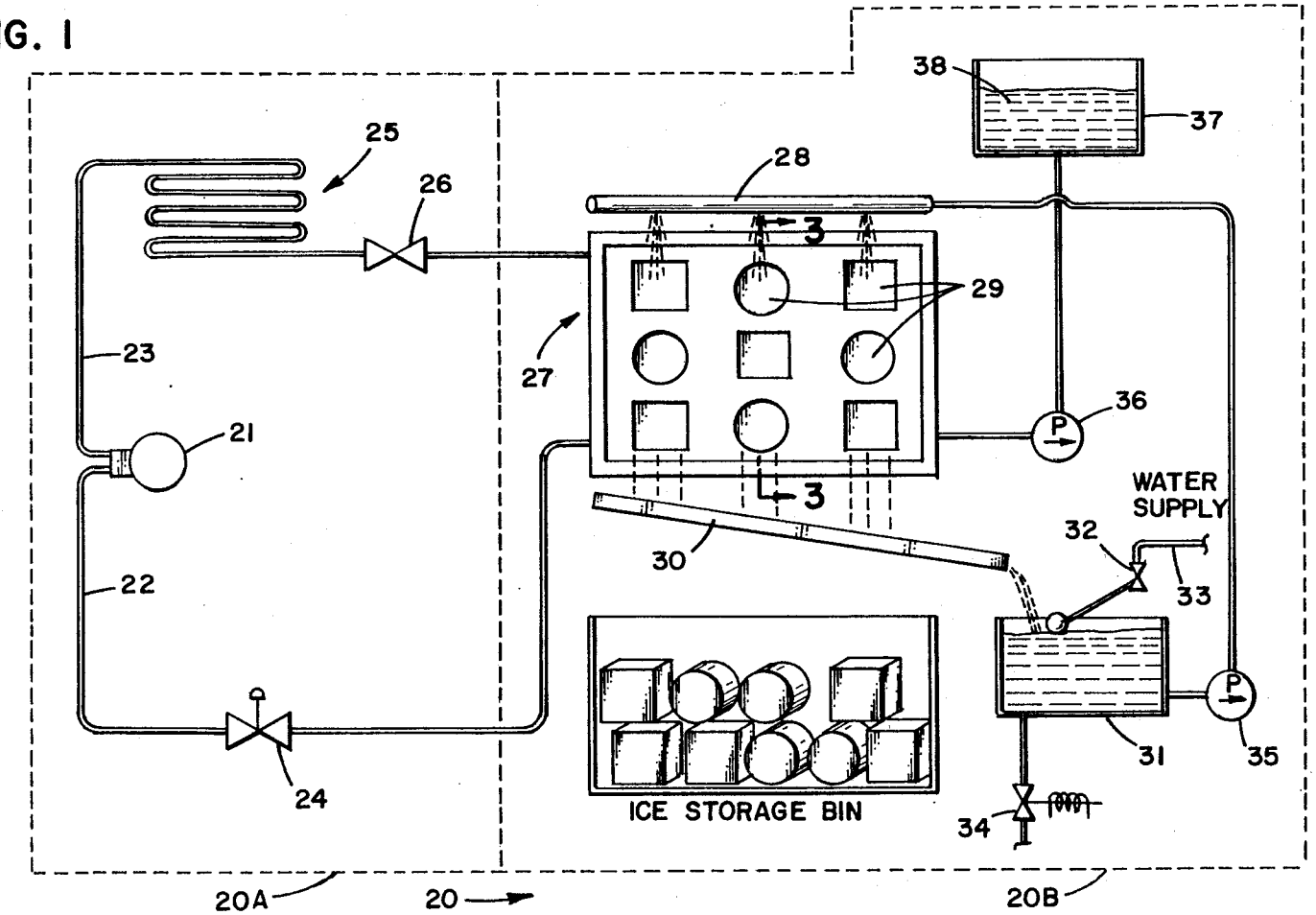
FIG. 1 is a schematic diagram illustrating the refrigeration circuit and water supply circuit of the present invention.

Referring now to the Drawings, wherein like reference numerals designate like or corresponding parts throughout the views, and particularly referring to FIG. 1, there is illustrated a schematic diagram of a refrigeration circuit 20 incorporating the invention. The refrigeration circuit 20 is divided into two segments 20A and 20B.

The segment 20A comprises that portion of the refrigeration circuit 20 which contains certain conventional elements. These elements include a compressor 21 having a suction line 22 and a discharge line 23. In the suction line 22 there is a suction pressure regulator 24 which establishes a constant head for the inlet of the compressor 21 to prevent overloading of the compressor. In the discharge line 23 there is a condenser 25 for condensing the compressed refrigerant vapor coming from the compressor 21, and an expansion valve 26 for flashing a portion of pressurized liquid refrigerant into a vapor thereby lowering the temperature and pressure of the remaining unvaporized refrigerant. Preferably the refrigerant is a halogenated hydrocarbon fluid.

The segment 20B comprises that portion of the refrigeration circuit 20 incorporating the present invention. To complete the refrigerant circuit 20, an evaporator 27 is connected between the discharge line 23 and the suction line 22. The details of evaporator 27 comprise significant features of the invention, as will be described hereinbelow.

Gaseous refrigerant is compressed, condensed to a liquid and then expanded, in the form of a liquid spray into the evaporator 27. Heat transferred into the liquid refrigerant causes it to evaporate. The evaporated refrigerant passes through suction line 22 back to the compressor 21.

FIG. 1 also illustrates the water supply circuit used to provide water to the evaporator 27 for making ice. A water supply manifold 28 sprays a continuous stream of water across the surface of the evaporator 27. The water which is not frozen at the freezing sites 29 while crossing the evaporator surface is collected below in a collection trough 30. The water then flows back into a tank or reservoir 31 A constant level of water is maintained in the reservoir 31 by means of a float valve 32 which regulates flow from the water supply 33. A drain solenoid valve 34 is provided to periodically drain the reservoir 31 to insure purity of the water. A pump 35 circulates water from the reservoir 31 to the water supply manifold 28.

Also shown in FIG. 1 is a pump 36 and a reservoir 37 for holding heat transfer fluid 38. The pump 36 and the reservoir 37 are used in the operation of the evaporator 27 as will be described.

Figure 2:
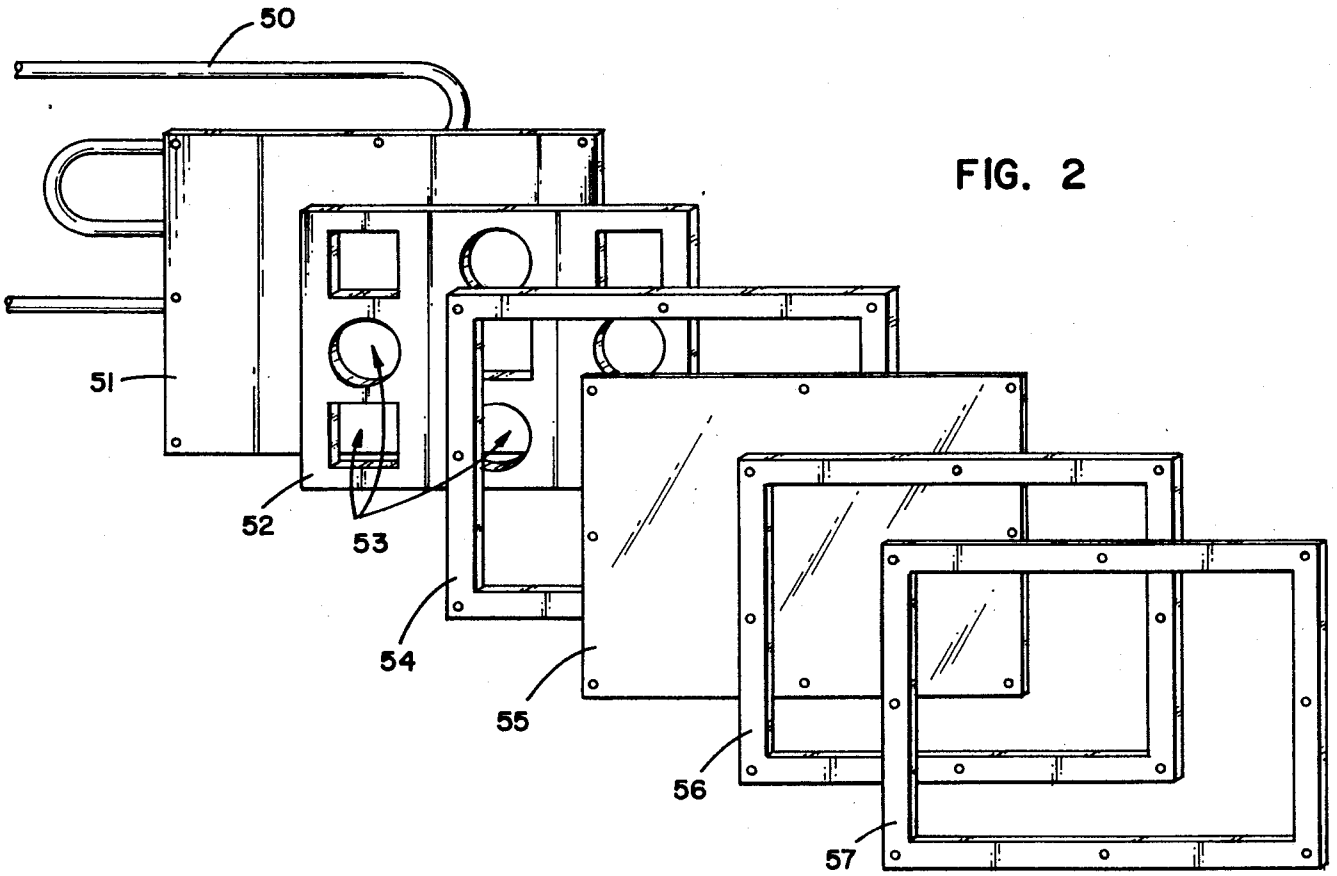
FIG. 2 is an exploded view of the preferred embodiment of the ice making apparatus.

FIG. 2 is an exploded view of the evaporator 27. Starting from the back, the evaporator 27 is comprised of a serpentine length of copper tubing 50 through which the refrigerant passes. The copper tubing 50 is connected directly to a copper plate 51 so that there is good conduction of heat between the tubing and the plate. Tubing 50 and plate 51 are preferably soldered together. Adjacent to the plate 51, but not physically attached to it, is a layer or sheet of insulating material 52. This insulating layer 52 has cut in it a series of holes 53 which define the freezing sites——those areas where ice can be formed. The rest of the insulating layer 52 inhibits heat transfer. The size and shape of the holes 53 determine the cross-sectional size and shape of the ice cubes produced by the present invention. Thus ice cubes of any desired cross-sectional shape can be made simply by inserting an insulating layer 52 with holes cut to the shape desired for the ice cube.

Also on the surface of the plate 51 will be a peripheral gasket 54. In front of the gasket 54 and the insulating layer 52 is the flexible freezing surface 55 (e.g., a thin (approximately 0.001 inch thick) sheet of stainless steel in the preferred embodiment). As will be explained more fully hereinafter, ice is formed on the front side of the flexible freezing surface 55. The space between the freezing surface 55 and the plate 51 (enclosing the insulating layer 52 between them) is sealed by gasket 54 and another gasket 56 to define a sealed chamber therebetween. The entire assembly is held in place by a retaining frame 57 which can be fastened to the plate 51 by bolts or other retaining means.

Figure 3:
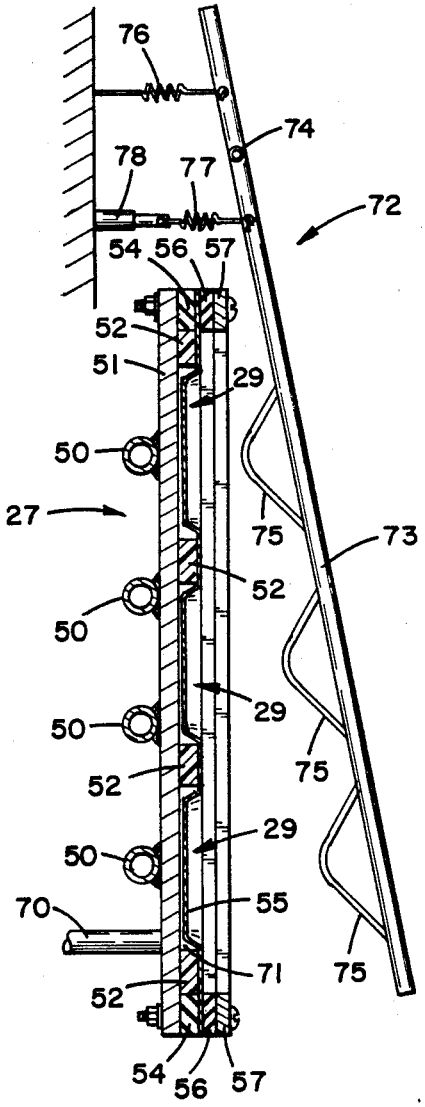
FIG. 3 is a cross-sectional view, taken along the line 3—3 of FIG. 1.

FIG. 3 is a cross-sectional view of the evaporator 27 when assembled.

Line 70 carries heat transfer fluid from the evaporator 27 to the pump 36 shown in FIG. 1. This heat transfer fluid fills the chamber 71 between the flexible freezing surface 55 and the copper plate 51 and provides good heat transfer between the freezing surface and the refrigerated plate 51. The heat transfer fluid also prevents water or moisture from collecting and freezing in the chamber 71. Pump 36 functions to remove the heat transfer fluid from chamber 71 causing the freezing surface 55 to be drawn into near contact with the plate 51 (a very thin layer of the heat transfer fluid remains between the two surfaces and enhances heat transfer). When pump 36 is turned off, heat transfer fluid may flow freely back into the chamber 71, allowing the flexible freezing surface 55 to flex so that the ice can be easily removed from the freezing surface 55.

FIG. 3 also illustrates the preferred embodiment of an ice removing assembly 72, comprised of a stainless steel frame 73 supported on a hinge 74. Attached to the frame 73 are electrical resistance heating wires 75, which are normally de-energized and at ambient temperature. The wires 75 are connected to an electrical current source (not shown). The frame is also connected to springs 76 and 77 and a solenoid 78 which are used to pivot the ice removing assembly 72 toward or away from the freezing surface 55 as desired.

In the alternative, an independent ice removing assembly for each individual freezing site 29 could be provided. This alternate ice removing means may be necessary on larger evaporator assemblies where there can be a significant discrepancy in the heat transfer rates between different freezing sites, resulting in much thicker ice layers on some freezing sites than others. Independent ice removing means for each individual freezing site can better accommodate the different thicknesses of the ice layers in this situation.

Figure 4:
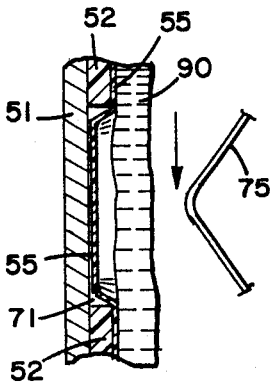
FIG. 4 through FIG. 10 are fragmentary cross-sectional views of the ice making apparatus illustrating the sequence of operation of the present invention.

Referring now to FIGS. 4–10, the sequence of operation of the present invention will now be described. FIG. 4 shows a fragmentary cross-sectional view of the evaporator 27. Shown is the copper plate 51, the insulating layer 52, the flexible freezing surface 55, the chamber 71 which is filled with heat transfer fluid and the resistance heating wires 75. FIG. 4 also shows water 90 flowing across the surface of the freezing surface 55 in the direction of the arrow.

To initiate the freezing process, the compressor 21 and the water circulating pump 35 are started, and the heat transfer fluid pump 36 is turned on to pull the fluid from chamber 71. As the heat transfer fluid is drawn out of chamber 71 by pump 36, the freezing surface 55 is brought into intimate contact with the plate 51 for good heat transfer between the two. Heat is then conducted from the warm water, through the freezing surface 55, through the refrigerated plate 51, and into the refrigerant. This causes the water 90 to cool down to its fusion temperature (32 degrees F, 0 degrees C), after which ice begins to form at the freezing sites 29. Heat transfer from the water 90 in areas other than the freezing sites 29 is prevented by the insulating layer 52.

Figure 5:
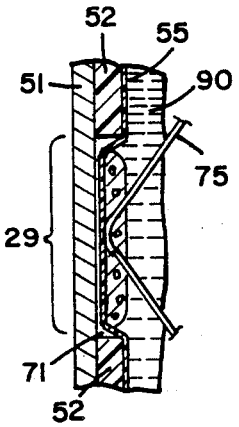

FIG. 5 shows a freezing site 29 after the heat transfer fluid has been pumped out of the chamber 71 causing a first layer of ice 91 to form. While the first layer of ice 91 is forming, the resistance heating wires 75 are brought into contact with the freezing surface 55. The first layer of ice 91 freezes over the wires 75 so that the wires are imbedded in the ice layer.

Figure 6:
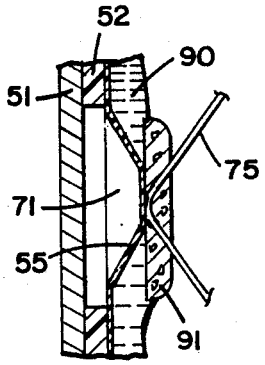

Once the first ice layer 91, as shown in FIG. 6, has reached the desired thickness, pump 36 is turned off allowing the heat transfer fluid to return to chamber 71 thus making it easier for the wires 75 to be retracted to disengage the first layer of ice 91 from the freezing surface 55. The flexible nature of the freezing surface 55 allows ice to be pulled free, which would not be possible with a rigid surface. The ice layer 91 is still firmly attached to the wires 75 after the ice has released from the freezing surface 55.

Figure 7:
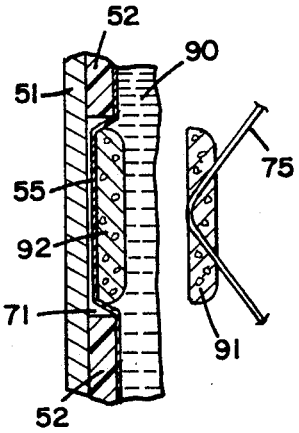

FIG. 7 shows the first ice layer 91 having been separated from surface 55 and retracted, but supported on wires 75, and the heat transfer fluid again pumped out of chamber 71. A second layer of ice 92 has been formed.

Figure 8:
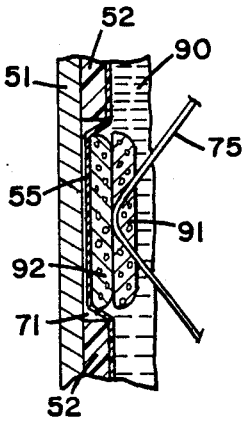

FIG. 8 shows ice layers 91 and 92 brought together by moving the resistance heating wires 75 to the freezing surface 55. Held in this position, the two ice layers will freeze (or laminate) together, forming a single, thicker piece of ice. This new single ice layer is then removed so that more layers can be formed and then laminated into a large piece of ice.

Figure 9:
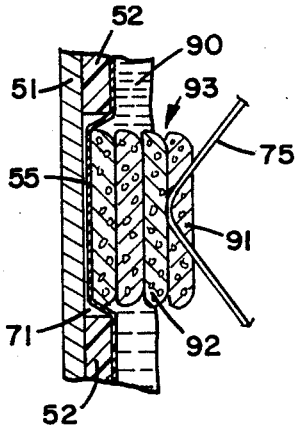
Figure 10:
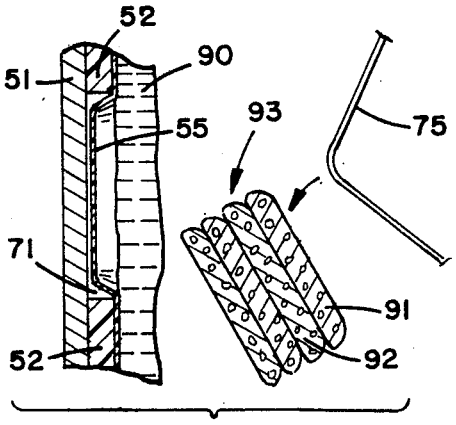

FIG. 9 shows the laminated ice cube 93 resulting from repeatedly performing steps illustrated in FIGS. 5 through 8. When the laminated ice has enough layers to form a cube of the desired size, it is removed from the freezing surface 55 for harvesting by applying a voltage to resistance heating wires 75. This causes the cube 93 to melt free of the wires 75 and drop into an ice storage bin as shown in FIG. 10.

While the ice cube 93 is melting free of the resistance heating wires 75, drain solenoid valve 34 opens, allowing the water in the water supply reservoir 31 to drain out. Float valve 32 opens re-filling reservoir 31 with warmer fresh water. In addition to flushing the water supply, this warmer water will inhibit the formation of new ice layers until the ice cubes 93 have completely melted free and the resistance heating wires 75 can be brought back into contact with the flexible freezing surface 55 as shown in FIG. 5. When the ice cubes have completely melted free, the drain valve 34 is closed and the voltage is removed from the resistance heating wires 75. The freezing process then repeats until the ice storage bin has been filled with ice cubes.

Figure 11:
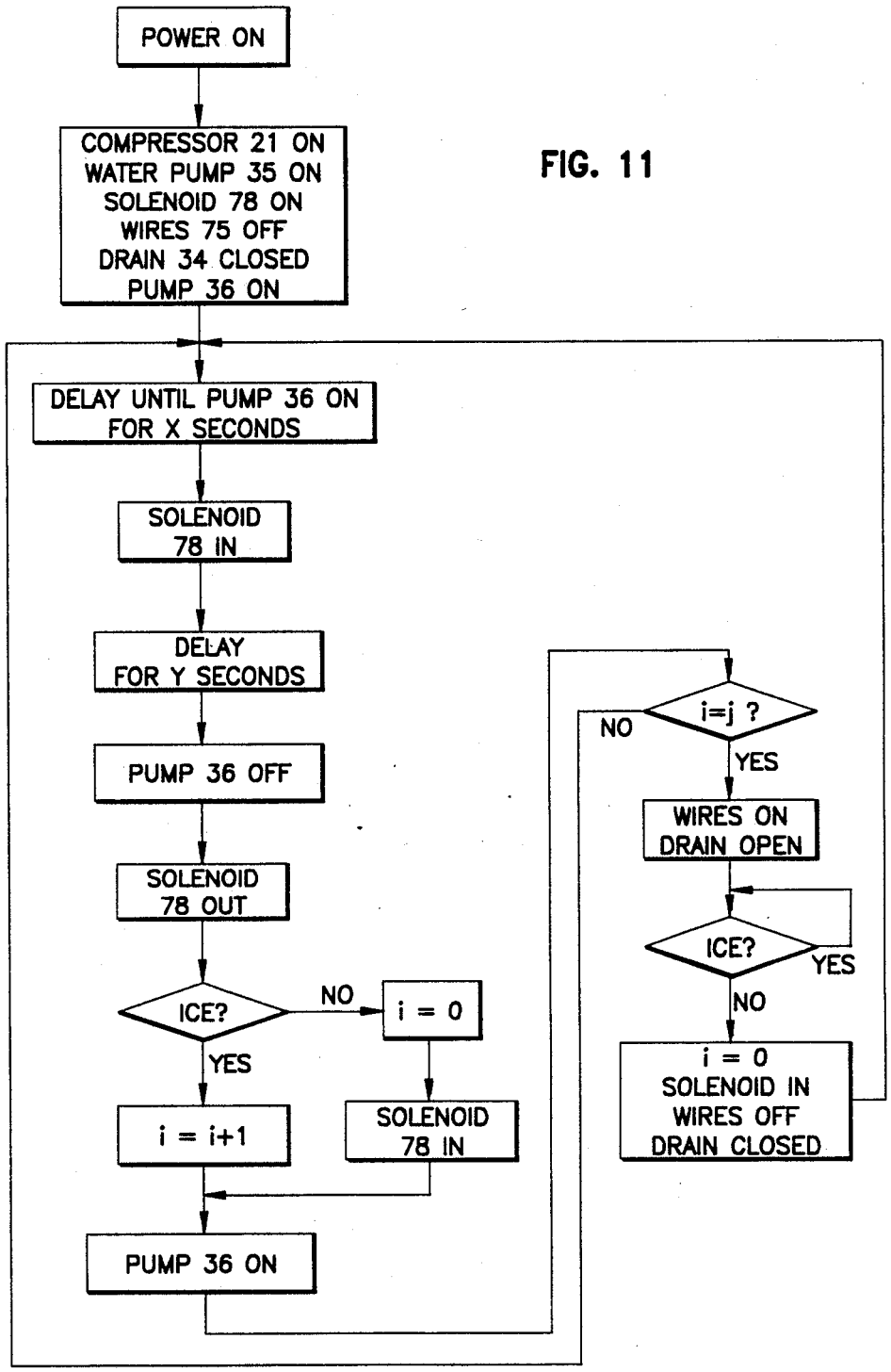
FIG. 11 is a flow-chart of the control logic used to control the sequencing and operation of the present invention.

FIG. 11 is a flow-chart of the control logic for the freezing process in the present invention. It begins when the power to the ice machine is turned on. Immediately, the compressor 21, water circulating pump 35 and the heat transfer fluid pump 36 are turned on. The drain solenoid valve 34 is held closed, the resistance heating wires 75 are off, and the solenoid 78 controlling the position of the ice removing assembly 72 is in (so that the wires 75 are in contact with the freezing surface). After a suitable time delay of X seconds, adjustable in accordance with the thickness of each ice layer, the solenoid 78 is pulled in (this is a redundant command at start-up since the solenoid is already in). The apparatus then waits a time delay of Y seconds (the delay needed to insure that the ice layers are fused——again not needed at start-up). The heat transfer fluid pump 36 is then turned off (disabling freezing and allowing ice removal) and the solenoid 78 is commanded out. An ice sensor to detect the presence of an ice layer (described later in FIGS. 12, 13 and 14) will then indicate whether there is an ice layer on the wires. At start-up there will be no ice, so the ice layer counter (i) is set to zero, the solenoid 78 is commanded back in to the freezing surface 55 and the heat transfer fluid pump 36 is restarted to enable freezing. The process repeats until an ice layer is sensed on the wires 75.

When ice is sensed on the wires 75, the ice layer counter (i) is incremented by one. At this point the solenoid 78 is out, holding an ice layer away from the freezing surface, and the pump 36 is turned back on to enable freezing. After X seconds, the first ice layer 91 is brought into contact with the second ice layer 92 for Y seconds to fuse the two layers together, the pump 36 is turned off, and the two layers now laminated together are drawn away from the freezing surface. The ice layer counter is again incremented by one, another ice layer is frozen and laminated onto the previous layer. This repeats until the desired number of layers (j) have been laminated ($i=j$). When $i=j$, with the solenoid 78 out so the wires 75 and attached ice cubes 93 are away from the freezing surface 55 and the heat transfer fluid pump 36 on, the wires are turned on and the drain valve 34 is opened. This causes the ice cubes 93 to begin melting free of the resistance heating wires 75 and the water to drain from the water supply reservoir 31 while fresh water refills the reservoir from valve 32. When the ice cubes 93 have melted completely free of the wires 75, as indicated by the ice sensor, the solenoid 78 will be commanded in, returning the wires to the position needed to begin growing the first ice layer of the next cube. The resistance heating wires 75 are then turned off, and the drain valve 34 is closed. The process then starts again. This sequence repeats until the ice storage bin has been filled.

Figure 12:
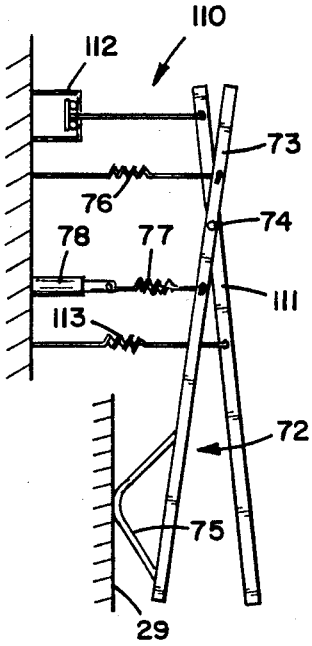
FIGS. 12 through 14 are schematic diagrams of the ice sensing means employed in the preferred embodiment.
Figure 13:
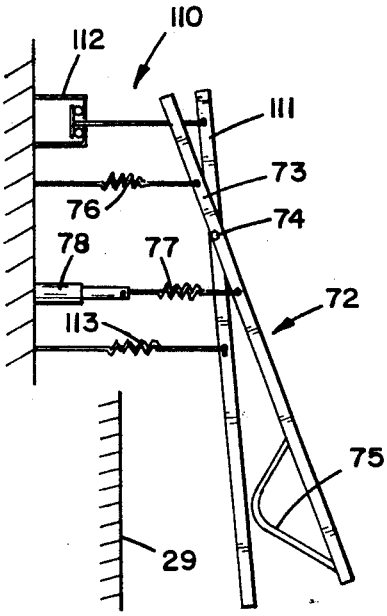
Figure 14:
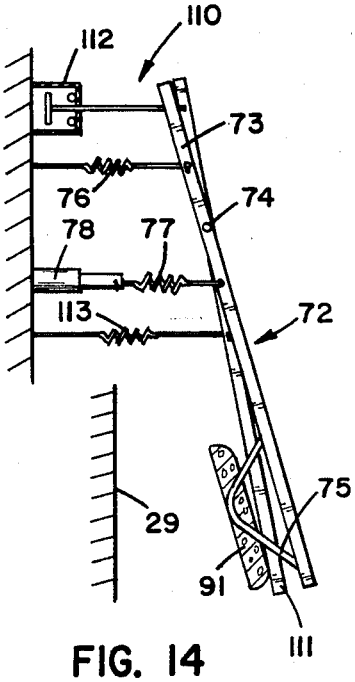

FIGS. 12 through 14 illustrate a preferred embodiment of an ice sensing assembly 110, and the operation thereof, which is used to determine the presence of an ice layer attached to the resistance heating wires. FIG. 12 shows an ice removing assembly 72 comprising the stainless steel frame 73 which is hinged at 74, the resistance heating wires 75, springs 76 and 77, and solenoid 78. The ice sensing assembly 1210 comprises a stainless steel rod 111 which is also hinged at 74 and which is attached to switch 112 and spring 113. FIG. 12 shows the position of the ice removing assembly 110 when it is in contact with the freezing site 29. When the ice removing assembly 110 is in this position, switch 112 is closed indicating no ice.

FIG. 13 shows the ice sensing assembly 110 when it has been pulled away from the freezing site 29 and there is no ice. In this situation, rod 111 does not change position and switch !12 remains closed indicating no ice.

FIG. 14 shows the ice sensing assembly 110 when it has been pulled away from the freezing site 29 and an ice layer 91 is attached to the resistance heating wires 75. In this situation, the ice layer 91 mechanically interferes with rod 111 pulling it out of its previous position. This causes switch 112 to open, thus indicating the presence of an ice layer.

In addition to sensing the presence of an ice layer when it is initially formed, the ice sensing assembly 11O has two other functions: (1) the rod 111 tends to pull the ice layer 91 (due to the force of spring 112) off the wires 75, thus facilitating the removal of the ice layer when the wires are heated, and (2) it indicates when the ice layer 91 has been completely removed from the wires 75 at the completion of an ice cube forming cycle.

Figure 15:
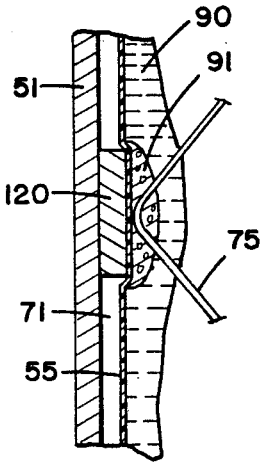
FIG. 15 is a fragmentary cross-sectional view of an alternate embodiment of the ice making apparatus.

FIG. 15 shows an alternate embodiment wherein the freezing sites as defined by holes in an insulating layer are replaced instead by raised freezing sites 120 on the refrigerated plate 51. The raised freezing sites 120 can comprise integral bosses or separate pieces of copper attached to the surface 55. Otherwise, FIG. 15 is identical to FIG. 5. Although this method does not allow the ice cube cross-sectional shapes to be as easily reconfigured as does the preferred embodiment, it is appropriate when the flexible freezing surface is less pliable (e.g., when it is made of 0.001 stainless steel).

Another alternate embodiment is similar to the preferred embodiment except that instead of simply turning off the heat transfer fluid pump 36 to disable freezing and allow ice removal, the pump is actually reversed. This causes the flexible freezing surface to be pushed out by fluid pressure into a convex shape (relative to the ice) facilitating ice removal when the flexible freezing surface is less pliable.

From the foregoing it will thus be apparent that the present invention comprises an improved ice making machine and method having numerous advantages over the prior art. The primary advantages is that no hot gas defrost is utilized. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications, and/or rearrangement of elements falling within the scope of the invention as defined by the following claims.

What I claim is:

1. Apparatus for freezing water or other liquid, comprising:

a thin flexible freezing surface which is held in intimate contact with a rigid refrigerated surface such that said flexible surface is in good heat transfer relation with the refrigerated surface and then removing the resulting frozen liquid from the flexible freezing surface without defrosting by flexing said flexible freezing surface to break the bond between said frozen liquid and said flexible freezing surface.

one or more raised freezing sites between said flexible freezing surface and said refrigerated surface such that the only areas where said flexible freezing surface can be in good heat transfer relation with said refrigerated surface is at said raised freeing sites thereby limiting the areas where liquid can be frozen on said flexible freezing surface to the areas defined by said raised freezing sites, and said raised freezing sites allowing the cross-sectional shape of the frozen liquid to be defined and controlled to a controlled shape defined by the shape of said raised freezing sites.

2. A method for making ice cubes, comprising the steps of:

positioning a layer of insulation between one side of a flexible sheet and a refrigerated plate, said insulation including a plurality of spaced-apart openings therein;

flowing water across the other side of a sheet of flexible material;

urging the flexible sheet through the openings in the layer of insulation and into thermal contact with the refrigerated plate to form freezing sites with a layer of ice frozen at each;

urging the flexible sheet away from the refrigerated plate to release the layer of ice formed at each freezing site;

holding the released layers of ice;

again urging the flexible sheet through the openings in the layer of insulation and into thermal contact with the refrigerated plate to form another layer of ice at each freezing site;

bringing the previously released ice layer into contact with the newly formed layer, causing the two ice layers to freeze together into a single cube of ice; and again urging the flexible sheet away from the refrigerated plate to release the ice cube.

3. Apparatus for making ice comprising:

a thin flexible ice forming surface;

a refrigerated surface proximate said thin flexible ice forming surface, forming areas of high thermal conductivity and areas of low thermal conductivity on said thin flexible ice forming surface; said refrigerated surface having, an evaporator plate having a planar surface, and having an insulator sheet having one or more apertures formed therein, located on said evaporator plate, thereby defining areas of high thermal conductivity proximate said apertures, and defining areas of low thermal conductivity adjacent said insulator sheet;

a water supply manifold adjacent said ice forming surface for distributing water onto said ice forming surface;

means for flexing said ice forming surface into engagement with said refrigerated surface whereby said ice is formed on said ice forming surface at said areas of high thermal conductivity and said ice is not formed on said ice forming surface at said areas of low thermal conductivity;

means for flexing said ice forming surface away from said refrigerated surface of disengaging said ice from said ice forming surface.

4. Apparatus for making ice comprising:

a thin flexible ice forming surface;

a refrigerated surface proximate said thin flexible ice forming surface, forming areas of high thermal conductivity and areas of low thermal conductivity on said thin flexible ice forming surface; said refrigerated surface having, an evaporator plate having raised planar areas defining areas of high thermal conductivity and having recessed areas defining areas of low thermal conductivity;

a water supply manifold adjacent said ice forming surface for distributing water onto said ice forming surface;

means for flexing said ice forming surface into engagement with said refrigerated surface whereby said ice is formed on said ice forming surface at said areas of high thermal conductivity and said ice is not formed on said ice forming surface at said areas of low thermal conductivity;

means for flexing said ice forming surface away from said refrigerated surface for disengaging said ice from said ice forming surface.

5. Apparatus for making ice comprising:

a thin flexible ice forming surface;

a refrigerated surface proximate said thin flexible ice forming surface, forming areas of high thermal conductivity and areas of low thermal conductivity on said flexible ice forming surface, said refrigerated surface having, sealing means coupled to said refrigerated surface and said flexible ice forming surface for defining a chamber, and having fluid pumping means for introducing a fluid into said chamber for flexing said ice forming surface;

a water supply manifold adjacent said ice forming surface for distributing water onto said ice forming surface;

means for flexing said ice forming surface into engagement with said refrigerated surface whereby said ice is formed on said ice forming surface at said areas of high thermal conductivity and said ice is not formed on said ice forming surface at said areas of low thermal conductivity;

means for flexing said ice forming surface away from said refrigerated surface for disengaging said ice from said ice forming surface.

6. The apparatus of claim 5 wherein said fluid is a gas.

7. The apparatus of claim 5 wherein said fluid is a liquid.

8. Apparatus for making ice comprising:

a thin flexible ice forming surface;

a refrigerated surface proximate said thin flexible ice forming surface, forming areas of high thermal conductivity and areas of low thermal conductivity on said on said thin flexible ice forming surface;

a water supply manifold adjacent said ice forming surface for distributing water onto said ice forming surface;

means for flexing said ice forming surface into engagement with said refrigerated surface whereby said ice is formed on said ice forming surface at said areas of high thermal conductivity and said ice is not formed on said ice forming surface at said areas of low thermal conductivity;

means for flexing said ice forming surface away from said refrigerated surface for disengaging said ice from said ice forming surface;

ice removing means for selectively removing said ice from said freezing sites and for returning said ice to said freezing sites whereby a laminated ice cube is assembled.

9. The apparatus of claim 8 wherein said ice removing means comprises electrical resistance heating wires which allow said laminated ice cube to be melted free of said wires by passing an electric current through said wires.

* * * * *